US007628733B2

(12) United States Patent
Donner et al.

(10) Patent No.: US 7,628,733 B2
(45) Date of Patent: Dec. 8, 2009

(54) TREADMILL DECK MECHANISM

(75) Inventors: Matthew A. Donner, Andover, MN (US); Peter H. Haugen, Eden Prairie, MN (US); Bradley H. Grossmann, St. Paul, MN (US)

(73) Assignee: Brunswick Corporation, Lake Forest, IL (US)

( * ) Notice: Subject to any disclaimer, the term of this patent is extended or adjusted under 35 U.S.C. 154(b) by 688 days.

(21) Appl. No.: 11/182,468

(22) Filed: Jul. 15, 2005

(65) Prior Publication Data

US 2007/0015635 A1 Jan. 18, 2007

(51) Int. Cl.
*A63B 22/00* (2006.01)

(52) U.S. Cl. ..... 482/54

(58) Field of Classification Search ..... 482/51, 482/54; 198/837, 841
See application file for complete search history.

(56) References Cited

U.S. PATENT DOCUMENTS

| | | | | |
|---|---|---|---|---|
| 1,964,405 | A * | 6/1934 | Nenne | 248/429 |
| 4,350,336 | A | 9/1982 | Hanford | 272/69 |
| 4,974,831 | A * | 12/1990 | Dunham | 482/54 |
| 5,167,393 | A * | 12/1992 | Hayakawa et al. | 248/430 |
| 5,279,528 | A | 1/1994 | Dalebout et al. | 482/54 |
| 5,382,207 | A * | 1/1995 | Skowronski et al. | 482/54 |
| 5,827,155 | A * | 10/1998 | Jensen et al. | 482/54 |
| 5,976,061 | A | 11/1999 | Moon et al. | 482/54 |
| 5,993,358 | A * | 11/1999 | Gureghian et al. | 482/54 |
| 6,013,011 | A * | 1/2000 | Moore et al. | 482/54 |
| 6,053,848 | A | 4/2000 | Eschenbach | 482/54 |
| 6,174,267 | B1 * | 1/2001 | Dalebout et al. | 482/54 |
| 6,280,362 | B1 * | 8/2001 | Dalebout et al. | 482/54 |
| 6,572,513 | B1 * | 6/2003 | Whan-Tong et al. | 482/54 |
| 6,623,407 | B2 * | 9/2003 | Novak et al. | 482/54 |
| 6,652,424 | B2 * | 11/2003 | Dalebout | 482/54 |
| 6,821,230 | B2 * | 11/2004 | Dalebout et al. | 482/51 |
| 6,945,913 | B2 * | 9/2005 | Moore et al. | 482/54 |
| 2003/0139261 | A1 * | 7/2003 | Kuo | 482/54 |
| 2004/0147372 | A1 | 7/2004 | Wang et al. | |
| 2005/0164839 | A1 * | 7/2005 | Watterson et al. | 482/54 |
| 2005/0250622 | A1 * | 11/2005 | Chang | 482/54 |

* cited by examiner

*Primary Examiner*—Fenn C Mathew
*Assistant Examiner*—Andrew M Tecco
(74) *Attorney, Agent, or Firm*—Michael B. McMurry

(57) ABSTRACT

To provide variable resilient support for the deck of an exercise treadmill one or more resilient members are secured to the deck and a moveable support member is used to selectively engage the resilient members to provide support for the deck. A user operated adjustment mechanism can be used to move the support member or support members longitudinally along the treadmill thus effectively changing the number of resilient support members supporting the deck.

17 Claims, 3 Drawing Sheets

TREADMILL DECK MECHANISM

FIELD OF THE INVENTION

The invention generally relates to exercise equipment, and more particularly to human operated exercise treadmills.

BACKGROUND OF THE INVENTION

Exercise treadmills are widely used for various purposes. Exercise treadmills are, for example, used for performing walking or running aerobic-type exercise while the user remains in a relatively stationary position, further, exercise treadmills are used for diagnostic and therapeutic purposes. For all of these purposes, the person on the exercise treadmill normally performs an exercise routine at a relatively steady and continuous level of physical activity. Examples of such treadmills are illustrated in U.S. Pat. Nos. 4,635,928, 4,659,074, 4,664,371, 4,334,676, 4,635,927, 4,643,418, 4,749,181, 4,614,337, 6,095,951 and 6,572,512.

Exercise treadmills typically have an endless running surface which is extended between and movable around two substantially parallel pulleys at each end of the treadmill. The running surface usually includes a belt made of a flexible material extended around the pulleys. A drive unit rotating one of the pulleys normally drives the belt. The speed of the drive unit is adjustable by the user through a set of user controls so that the level of exercise can be adjusted to simulate running or walking as desired.

The belt is typically supported by a deck or support surface beneath the upper surface of the belt. The deck is usually composed of wood or MDF, in order to provide the required support. In addition, a low-friction sheet or laminate is usually provided on the upper deck surface to reduce the friction between the deck and the belt. In most cases, decks are relatively rigid which can result in high impact loads on the user's feet, ankles and knees as the user's feet contact the belt and the deck. Users often perceive this as being uncomfortable and further can result in unnecessary damage to joints as compared to running on a softer surface.

Because the typical treadmill has a very stiff, hard running surface and can become uncomfortable for extended periods of running, manufacturers have sought to make the running surface more resilient in an attempt to improve user comfort. U.S. Pat. Nos. 3,408,067, 4,350,336, 4,616,822, 4,844,449, 5,279,528, 5,441,468, 5,454,772 and 6,095,951 disclose examples of resilient deck support on treadmills to reduce impact loads. While generally successful at reducing impact loads, these approaches have certain disadvantages. In particular, it has been found that there is a substantial advantage in being able to vary the stiffness of the decks in treadmills to accommodate the desires or running styles of different users. As a result there have been a number of attempts to provide mechanisms for varying deck stiffness, examples of which are illustrated in U.S. Pat. Nos. 4,350,336, 6,623,407, and 6,821,230. However, these approaches suffer from a number of disadvantages. In the example described in U.S. Pat. No. 4,350,336, the location of two resilient support members can be changed but this results in uneven flexing of the deck along its length. In other cases, specially designed resilient members are used that are moved or rotated into position below the deck or complex mechanisms are required to implement user variation of deck flexibility. Moreover, these approaches do not provide a method for easy or inexpensive modification of an existing treadmill design to allow the user to vary deck flexibility or support.

SUMMARY OF THE INVENTION

Accordingly, it is an object of the invention to provides a user variable deck support structure for an exercise treadmill that can be readily installed in a treadmill and that is inexpensive and easy to operate. The variable deck support structure can include the same type of resilient support members already installed in the treadmill and can use support members movable along and beneath the treadmill deck by a simple lever mechanism to provide added support for the deck thus increasing its stiffness.

It is another object of the invention to provide an exercise treadmill having a deck support structure that includes one or more resilient support members attached to the deck along with an adjustment mechanism that permits a user to selectively move a support member under the resilient members in order to increase support of the deck. The adjustment mechanism can include a lever assembly to move the support member under the resilient members and can also include a latch mechanism to retain the support member in a particular position.

A further object of the invention is to provide an exercise treadmill that includes a resilient support member attached to the deck in combination with a support member that can moved by a user such that in a first position it does not provide support for the deck and in a second position the support member is located between the deck and the treadmill frame so as to provide added support for the deck thus effectively increasing the stiffness of the deck. Additional resilient members can be attached to the deck such that the support member can be moved under more than one resilient member so as to further increase deck stiffness. Also, a user operated adjustment mechanism having a lever pivotally attached to the treadmill frame and to the support member can be used to move the support member along a longitudinal treadmill frame member to position it under selected ones of the resilient support members.

Yet another object of the invention is to provide an exercise treadmill with one or more resilient support members attached along each side of the deck with a corresponding pair of support members which are longitudinally moveable beneath the deck where the support members have a shape that is effective to support the resilient support members on the treadmill frame thereby acting to increase the stiffness of the deck when the support members are moved beneath the resilient support members. An adjustment or translation mechanism can be used to move both support members simultaneously.

DETAILED DESCRIPTION OF THE INVENTION

Figure 1:
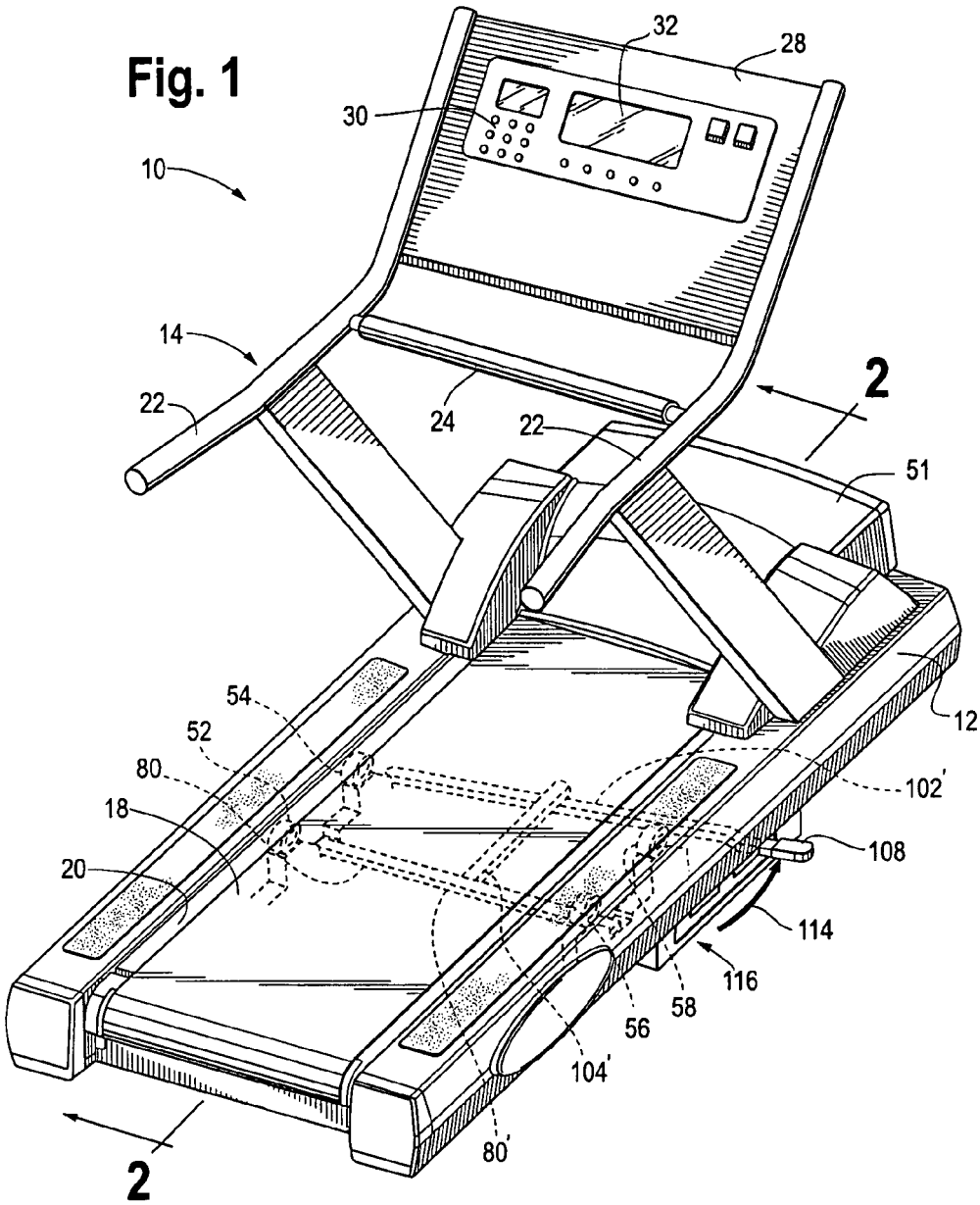
FIG. 1 is a perspective view of an exercise treadmill that provides a representative environment for the invention.

FIG. 1 provides an example of a type of an exercise treadmill 10 configured for human use in which the invention can be implemented. This particular treadmill 10 is generally described in detail in U.S. Pat. No. 6,572,512, issued Jun. 3, 2003, the disclosure of which is incorporated herein by reference and is merely provided as one example of the many types of treadmill in which the invention can be implemented. As is conventional in the treadmill art, the treadmill 10 includes a housing 12 and a user support 14 extending therefrom. As explained in further detail below, enclosed within the housing 12 is a frame 16, indicated generally in FIGS. 2 and 5, that rotatably supports a belt 18, the upper run of which moves along a deck 20. In the treadmill 10, the deck 20 is at least partially resiliently supported on the frame 16. It should be understood that the general construction of the treadmill 10 is merely exemplary in nature and the deck support of the present invention can be implemented in a wide variety of other exercise treadmill configurations.

The user support 14 includes a pair of side handrails 22 and a central handrail 24 that are supported above the base 12 by a pair of supports 26. The side handrails 22 and central handrail 24 provide lateral support for the user when running on the treadmill 10. A control panel 28 is supported between the side handrails 22 and enables the user to control operation of the treadmill 10. More specifically, the control panel 28 includes a plurality of input controls 30 that enable the user to control such operating parameters as speed, incline angle, work-out program and the like. The control panel 28 further includes a display 32 that provides visual indications of work-out parameters, which can include calories burned, equivalent distance traveled, heart rate and the like.

Referring to FIGS. 2 through 5, the frame 16 includes a pair of longitudinal frame members 34 and 36 that provide support for a pair of pulleys 40 and 42 and the deck 20. In this particular example 10 of a treadmill, the deck 20 in the first instance is resiliently supported on the frame 16 by a number of sets of elliptically shaped resilient support members indicated in FIG. 2 by 44, 46 and 48 where the resilient support members 44-48 are composed of an elastomeric material. In the example 10, of a treadmill shown in FIG. 2 there would be four sets of the resilient support members 44-48 with each of the resilient members 44-48 mounted on a set of u-shaped mounts 50 that are in turn secured to the longitudinal frame members 34 and 36. The resilient members 44-48 can be secured either to the deck 20 or the mounts 50. In one embodiment of the treadmill 10, the rearmost resilient member 44 and the forward most resilient member (not shown) are connected to both the deck 20 and the u-shaped mounts in order to secure the deck 10 to the frame 16. As is conventional in this type of treadmill structure, the resilient members 44-48 permit the deck to flex downwardly in response to the foot impact of a user running on the belt 18. The stiffness of the deck 20 depends on a number of factors including the size, thickness and composition of the deck as well as the number, location and composition of the resilient members. The belt 18 extends around the pulleys 40 and 42 for longitudinal movement and its upper run moves along the upper surface of the deck 20. The frame 16 further supports a drive unit 51, typically including an AC or DC electric motor and a transmission, which is coupled with the forward pulley 42 to drive the belt 18. As is conventional in human operated treadmills, the user via the control panel 28 controls the speed of the drive unit 51, and thus the belt 18. It should be appreciated that the drive unit 51 as depicted in FIG. 1 merely represents the various methods for moving a belt in exercise treadmills.

Figure 2:
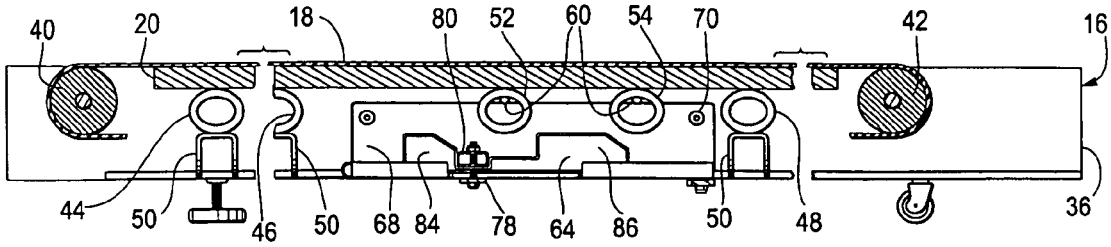
FIG. 2 is a sectioned side view of the treadmill of FIG. 1 taken along lines 2-2 of FIG. 1 illustrating a deck support adjustment mechanism according to the invention in a first position.
Figure 3:
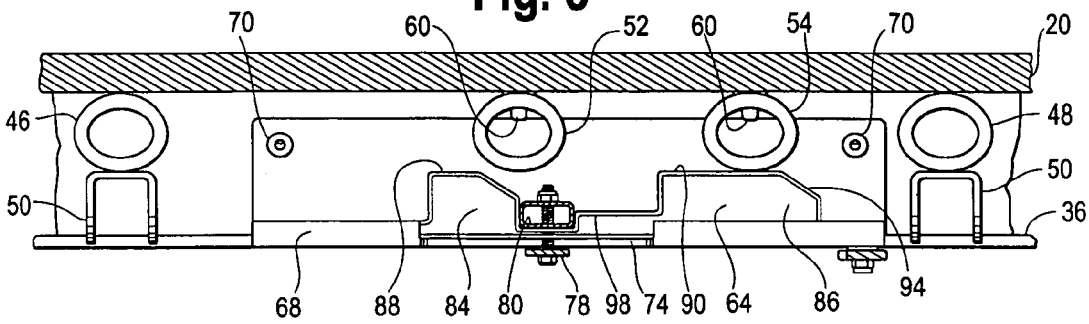
FIG. 3 is a partial sectioned side view of the treadmill of FIG. 1 illustrating the deck support adjustment mechanism of FIG. 2 in a second position.
Figure 4:
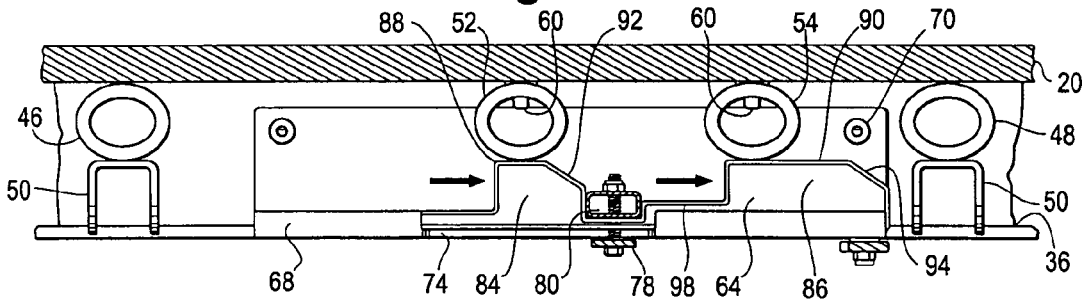
FIG. 4 is a partial sectioned side view of the treadmill of FIG. 1 illustrating the deck support adjustment mechanism of FIG. 2 in a third position.

FIGS. 1 through 5 also depict the preferred embodiment of the invention. In this embodiment, a set of four resilient support members 52, 54, 56, and 58 are secured to the deck 20 by a set of fasteners 60. In this embodiment the resilient support members 52-58 are located approximately at the midpoint and on each side of the deck 20 between the resilient support members 46 and 48 as shown in phantom in FIG. 1. To provide support for the resilient support members 52-58 on the frame 16, a pair of moveable support members 62 and 64 are slidably secured to longitudinal frame members 34 and 36 respectively such that the moveable support members can move a limited distance along the longitudinal frame members 34 and 36. In order to retrain in and facilitate movement of the moveable support members 62 and 64 along the longitudinal frame members 34 and 36, a pair of tracks 66 and 68 is secured to the longitudinal frame members 34 and 36 respectively. The tracks 66 and 68 can be secured to the frame members 34 and 36 by any number of methods including welding or a set of fasteners 70 as shown in FIGS. 2-4. Also as illustrated in FIGS. 2-5, a slot 72 and 74 is configured in tracks 66 and 68 respectively which permit a pair of fasteners 76 and 78, that connect a cross member 80 to each of the moveable support members 62 and 64, to move linearly along the longitudinal frame members 34 and 36. As described in more detail below, one of the functions of the cross member 80 is to insure that the moveable support members 62 and 64 move together in parallel. In this particular embodiment of the invention, each of the moveable support members 62 and 64 is configured with a planar bottom surface that allow the moveable support member 62 and 64 to move within the tracks 66 and 68. Additionally, each of the moveable support members 62 and 64 is configured with a pair of raised portions 84 and 86 each having an upper planar surface 88 and 90 along with an angled planar surface 92 and 94 that slopes downwardly from the upper surfaces 88 and 90.

An adjustment mechanism can be used to selectively provide additional support of the deck 20 on the frame structure 16 of the treadmill 10. By increasing the support of the deck 20, by in effect adding more support members such as the resilient members 52-58, the stiffness of the deck 20 can be increased thus decreasing the downward flex of the deck 20 under the foot impact of a user. FIGS. 1-7 depict a preferred embodiment 96 of such an adjustment mechanism. Included in the adjustment mechanism 96 are the movable support members 62 and 64.

Referring first to FIG. 2, the moveable support member 64 is shown as positioned in the track 68 in a first position toward the rear of the treadmill 10. As can be seen in FIG. 2, neither of the resilient support members 52 or 54 will be engaged with the moveable support member 68 and as a result the deck 20 will tend to flex downwardly to a maximum extent.

Next referring to FIG. 3, the moveable support member 64 is shown as positioned in the track 68 in a second position forward of the first position where the planar surface 90 of the raised portion 86 abuts the resilient support member 54. This will have the effect of increasing the support of the deck 20 and as a result the deck 20 will tend to flex downwardly to a lesser extent than when the moveable support member is in the first position of FIG. 2 thus giving the running surface 18 a firmer feel. As shown in FIG. 3, the vertical distance between a lower surface 98 of the moveable support member 64 and the resilient support members 52 and 54 is significantly greater than the vertical distance between the upper planar surface 88 and the resilient support members 52 and 54 in this embodiment of the adjustment mechanism 96. Thus, when the moveable support member 64 is positioned such that the raised portions 84 and 86 are not below the resilient support members 52 or 54, the greater vertical distance to the surface 96 will in effect disengage the resilient support members 52 and 54 from the frame 16.

Then referring to FIG. 4, the moveable support member 64 is shown as positioned in the track 68 in a third position forward of the second position. Here, both the planar surface 90 of the raised portion 86 abuts the resilient support member 54 and the planar surface 88 of the raised portion 84 abuts the resilient support member 52. Since the raised portion 86 is longer than the raised portion 84, both of the resilient support members 52 and 54 will be engaged with the moveable support member 64 when it is in this position thereby providing maximum support for the deck 20.

Figure 5:
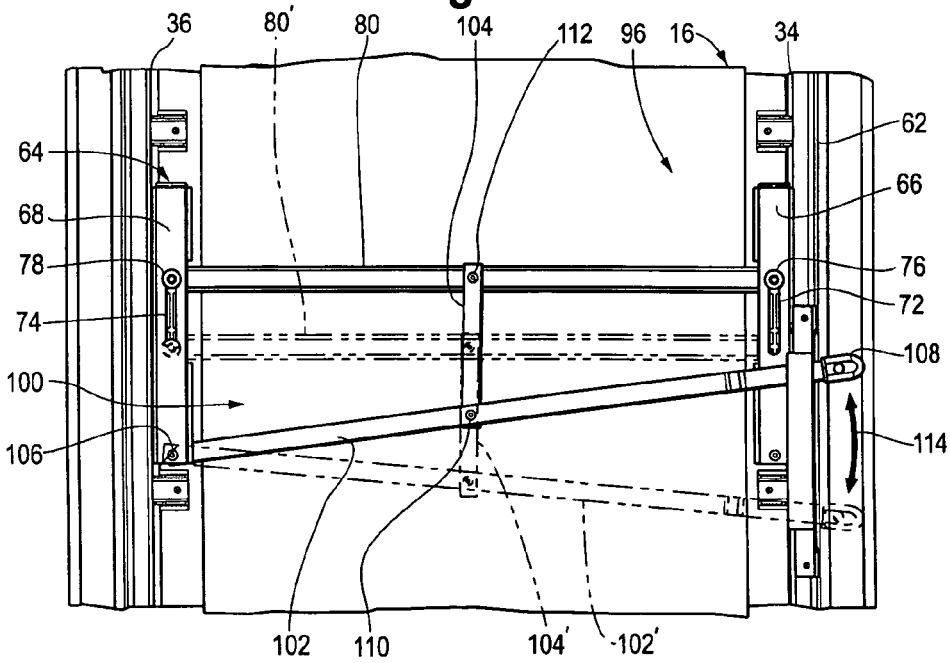
FIG. 5 is a partial bottom plan view of the treadmill of FIG. 1 illustrating the deck support adjustment mechanism of FIG. 2.
Figure 6:
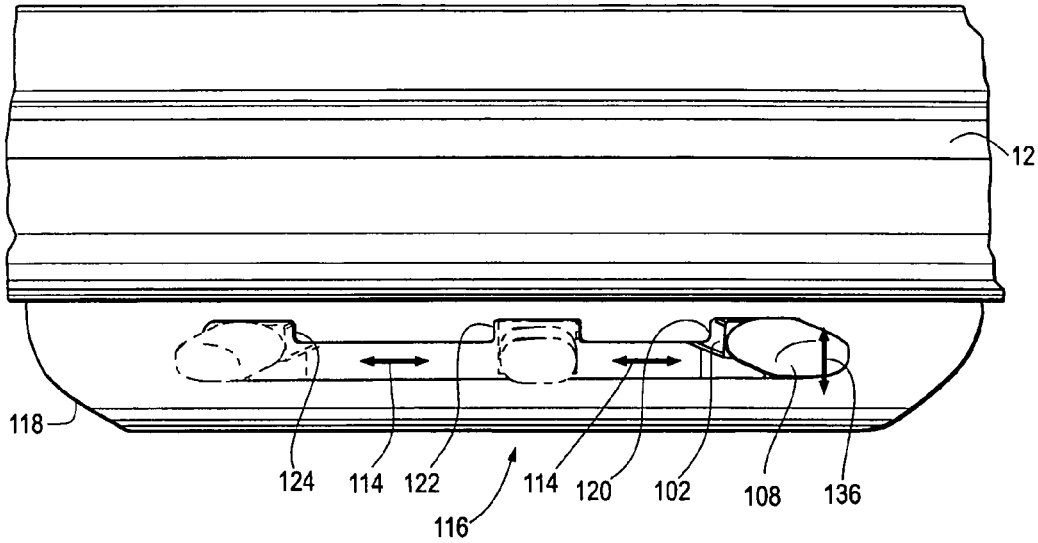
FIG. 6 is a partial exterior side view of the treadmill of FIG. 1 illustrating a latch mechanism for use with the deck support adjustment mechanism of FIG. 5.
Figure 7:
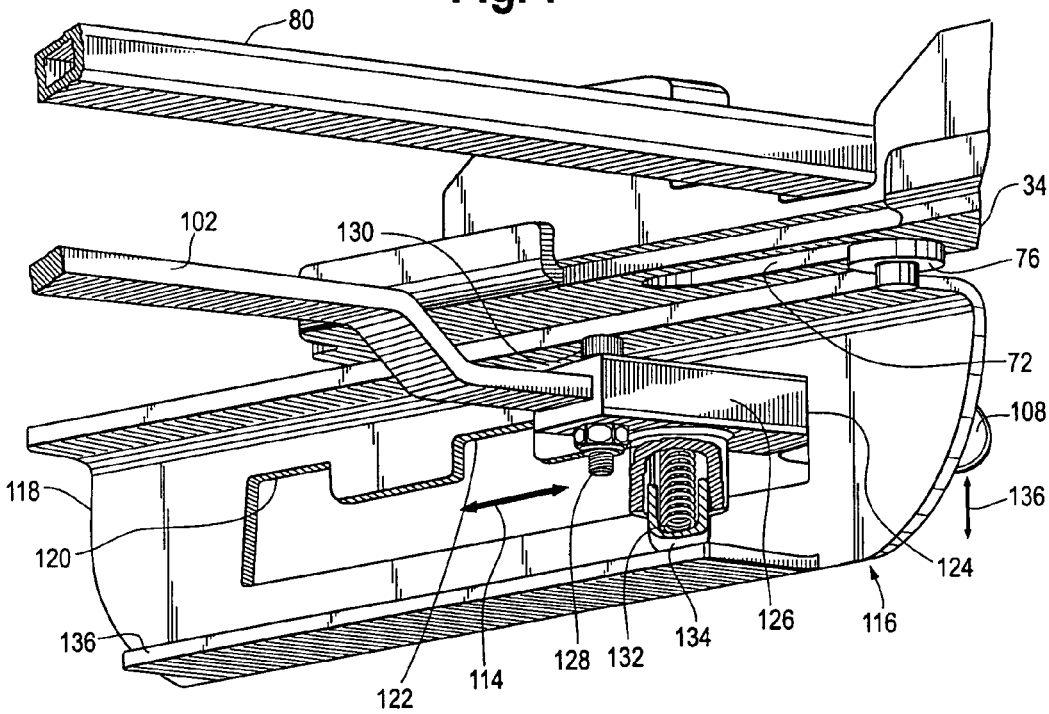
FIG. 7 is a partial interior perspective view of the latch mechanism of FIG. 5.

FIGS. 5-7 depict the preferred embodiment of another aspect of the adjustment mechanism 96. Linear movement of both of the moveable support members 62 and 64 together and in parallel along the longitudinal frame members 34 and 36 is provided by a translation mechanism indicated generally at 100. In this embodiment, the translation mechanism 100 includes the cross member 80, an adjustment lever 102 and a connection rod 104. The adjustment lever 102 is pivotally connected at one end to the longitudinal frame member 36 at a point 106 and the other end, having a handle 108 that serves as a user interface, extends out and beneath the other longitudinal frame member 34. The connection rod 104 is pivotally connected to the adjustment lever 102 at a point 110 and to the cross member 80 at a point 112. To operate the adjustment mechanism 96, the user simply moves the handle 108 as indicated by an arrow 114 which will cause the cross member 80 and hence the moveable support members 62 and 64 to move longitudinally to the three positions described above. Movement of the cross member 80, the adjustment lever 102, and the connection rod 104 are illustrated by a set of corresponding phantom elements 80', 102' and 104' in FIG. 5.

As illustrated in FIGS. 1, 6 and 7, the preferred embodiment of the invention includes a latching or retention mechanism, generally indicated at 116 that can be used to retain the moveable support members 62 and 64 in the three positions described above. In the embodiment 116 of latch mechanism shown in the figures, a bracket 118 is secured to the underside of the longitudinal frame member 34 and is configured with a set of three notches 120, 122 and 124 that effectively act as detents for the adjustment lever 102. Here, the notches 120-124 correspond to the three positions of the moveable support members 62 and 64 as described above. Included in the latch mechanism 116 is a latch member 126 that is configured to fit within each of the notches 120-124 and is secured by a fastener 128 to the end of the adjustment lever 102 and to the handle 108. In addition the fastener 128 is used to secure an elastomeric bumper 130, which abuts the underside of the bracket 118, to the latch member 126. To retain the latch member 126 in the notches 120-124, a spring loaded assembly 132, shown in broken away form in FIG. 7, is secured to the latch member 126 and includes a rounded lower surface 134 that can slide along a lower horizontal portion 136 of the bracket 118. To operate the adjustment mechanism 96, the user merely has to press down on the handle 108, as indicated by an arrow 136; move the adjustment lever 102 to the desired position as indicated by the notches 120-124; and release the handle 108.

One of the significant virtues of the adjustment mechanism 96 described above is that it can be readily and inexpensively installed in existing treadmill designs such as the treadmill 10. In this case, it is possible to use the same type of resilient support members for the additional support members 52-58 as are used for the previously installed resilient support members 44-48. In addition, installation of the moveable support members 62 and 64 and the other associated elements of the adjustment mechanism 96 is relatively simple.

As indicated above, the preferred embodiment of the invention has been described in the context of the particular treadmill 10. Various elements of the invention can be modified for different treadmill designs or user requirements. For example, the adjustment mechanism can be limited to one additional resilient support member or can be modified to include more than two additional resilient support members on each side of a treadmill deck. Although elliptically shaped resilient support members such as members 52-58 are preferred in this invention, partially because the rounded lower portions facilitate movement of the moveable members 62 and 64, other shapes and compositions can be used depending upon the desired flexibility of the treadmill deck and the configuration of the moveable support members. Similarly, the portion of the adjustment mechanism used to move the moveable members described above represents the preferred embodiment due to its simplicity, there are many other mechanical assemblies that can be used for this purpose. In addition, especially in more expensive treadmills, it would be possible to use other mechanisms that might, for example, use motors or linear actuators, to perform this function including utilizing the control panel 28 as a user interface.

We claim:

1. An exercise treadmill, comprising:

a frame structure including, a pair of spaced apart longitudinal frame members for providing longitudinal structural support for said frame structure;

a pair of rotatable pulleys secured to said frame, said pulleys being positioned substantially parallel to each other;

a drive unit for rotating a first one of said pulleys;

a deck member;

a belt secured over said pulleys so as to move in a longitudinal direction over said deck member when a first of said first pulleys is rotated;

a control panel secured to said frame structure and operatively connected to said drive unit wherein said control panel permits a user to control the speed of said belt; and a deck support structure including a first resilient member secured to said deck;

an adjustment mechanism including a moveable support member adapted to slide along one of said longitudinal frame members from a first position that provides a minimum or no support for said deck member into a second position between said first resilient member and a portion of said frame structure such that said first resilient member is effective to provide resilient support for at least a portion of said deck on said frame structure; and wherein said movable support member is configured to move generally in parallel with a first of said longitudinal frame members and is configured with a lower surface and a first upper surface such that the vertical distance between said lower surface and said first resilient member when said support member is in said first position is greater than the vertical distance between said first upper surface and said first resilient member when said support member is in said second position.

2. The treadmill of claim 1 additionally including a second resilient member secured to said deck wherein said support member can move into a third position between said second resilient member and a portion of said frame structure such that both said first resilient member and said second resilient member are effective to provide resilient support for at least a portion of said deck on said frame structure.

3. The treadmill of claim 1 additionally including a second resilient member secured to said deck wherein said support member can move into a third position between said second resilient member and a portion of said frame structure such that both said first resilient member and said second resilient member are effective to provide resilient support for at least a portion of said deck on said frame structure when said support member is in said third position and wherein said support member is additionally configured with a second upper surface such that the vertical distance between said lower surface and said second resilient member when said support member is in said first or said second position is greater than the vertical distance between said second upper surface and said second resilient member when said support member is in said third position.

4. The treadmill of claim 1 wherein said support member is additionally configured with a generally planar surface angled with respect to vertical and extending upwardly to said upper surface in order to facilitate said movement of said support member from said first position to said second position by providing a sliding surface for a lower surface of said first resilient member.

5. The treadmill of claim 1 wherein said adjustment mechanism includes a track secured to said first longitudinal frame member and said support member is configured to slide in said track from said first position to said second position.

6. The treadmill of claim 1 wherein said adjustment mechanism includes an adjustment lever pivotally secured a first end to said frame structure, having a second end extending outwardly past said first longitudinal frame member and pivotally connected to said support member effective to permit the user to move said support member from said first position to said second position by manipulating said second end of said adjustment lever.

7. The treadmill of claim 1 wherein said first resilient member is composed substantially of an elastomeric material.

8. The treadmill of claim 1 wherein said first resilient member has a generally elliptical configuration and is composed substantially of an elastomeric material.

9. An exercise treadmill, comprising:

a frame structure including, a pair of spaced apart longitudinal frame members for providing longitudinal structural support for said frame structure;

a pair of rotatable pulleys secured to said frame, said pulleys being positioned substantially parallel to each other;

a drive unit for rotating a first one of said pulleys;

a deck member;

a belt secured over said pulleys so as to move in a longitudinal direction over said deck member when a first of said first pulleys is rotated;

a control panel secured to said frame structure and operatively connected to said drive unit wherein said control panel permits a user to control the speed of said belt; and a deck support structure having a plurality of resilient members including a first and a second resilient member spaced laterally apart and secured to said deck at approximately the same longitudinal position; and an adjustment mechanism including:

a first moveable support member adapted to slide along a first of said longitudinal frame members from a first position that provides a minimum or no support for said deck member into a second position between said first resilient member and a portion of said frame structure such that said first resilient member is effective to provide resilient support for at least a first portion of said deck on said frame structure;

a second moveable support member adapted to slide along a second of said longitudinal frame members from a first position that provides a minimum or no support for said deck member into a second position between said second resilient member and a portion of said frame structure such that said second resilient member is effective to provide resilient support for at least a second portion of said deck on said frame structure;

a user operable translation mechanism including a user interface for permitting the user to selectively move said first and second support members from said first positions to said second positions; and wherein said translation mechanism includes a cross member secured to said first and to said second support members, an adjustment lever pivotally secured at a first end to said frame structure and having a second end extending outwardly past said first longitudinal frame member and a connection assembly connecting said adjustment lever to said cross member.

10. The treadmill of claim 9 wherein said connection assembly includes a connection member connected to said cross member and pivotally connected to said adjustment lever.

11. The treadmill of claim 9 wherein said user interface includes a handle secured to said second end of said adjustment lever.

12. The treadmill of claim 9 wherein said translation mechanism includes a latching mechanism secured to said frame structure effective to permit the user to selectively latch second end of said adjustment lever thereby being effective to retain said first and said second support members in said first or second positions.

13. The treadmill of claim 9 wherein said translation mechanism includes a latching mechanism to permit the user to selectively retain said first and said second support members in said first or second positions.

14. The treadmill of claim 9 wherein said deck support structure additionally includes a third and a fourth resilient member spaced laterally apart and secured to said deck at approximately the same longitudinal position;

wherein said first moveable support member can move into a third position between said third resilient member and a portion of said frame structure such that both said first resilient member and said third resilient member are effective to provide resilient support for at least a portion of said deck on said frame structure when said first moveable support member is in said third position and wherein said first moveable support member is additionally configured such that said third resilient member provides a minimum or no support to said deck when said first moveable support member is in said first or said second position; and wherein said second moveable support member can move into a third position between said fourth resilient member and a portion of said frame structure such that both said second resilient member and said fourth resilient member are effective to provide resilient support for at least a portion of said deck on said frame structure when said second moveable support member is in said third position and wherein said second moveable support member is additionally configured such that said fourth resilient member provides a minimum or no support to said deck when said second moveable support member is in said first or said second position.

15. The treadmill of claim 14 wherein said deck support structure additionally includes at least one set of laterally spaced resilient support members secured between said deck member and said frame structure longitudinally ahead of said first, second, third and fourth resilient support members and at least one set of laterally spaced resilient support members secured between said deck member and said frame structure longitudinally behind said first, second, third and fourth resilient support members.

16. An exercise treadmill, comprising:

a frame structure including, a pair of spaced apart longitudinal frame members for providing longitudinal structural support for said frame structure;

a pair of rotatable pulleys secured to said frame, said pulleys being positioned substantially parallel to each other;

a drive unit for rotating a first one of said pulleys;

a deck member;

a belt secured over said pulleys so as to move in a longitudinal direction over said deck member when a first of said first pulleys is rotated;

control means operatively connected to said drive unit for permitting a user to control the speed of said belt;

a deck support structure including a plurality of resilient members secured to said deck and at least one support member;

adjustment means for permitting the user to selectively slide said support member along one of said longitudinal frame members between said frame structure and one or more of said resilient members so as to increase or decrease support of said deck member; and wherein said support member is adapted to move longitudinally along one of said longitudinal frame members and said adjustment means includes a lever and latch assembly for moving said support member and latching it in one or more predetermined longitudinal positions.

17. The treadmill of claim 16 wherein said support member is configured with at least one planar raised surface to support said resilient member.

* * * * *

UNITED STATES PATENT AND TRADEMARK OFFICE

CERTIFICATE OF CORRECTION

PATENT NO. : 7,628,733 B2
APPLICATION NO. : 11/182468
DATED : December 8, 2009
INVENTOR(S) : Donner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1148 days.

Signed and Sealed this

Twenty-first Day of December, 2010

David J. Kappos

David J. Kappos
*Director of the United States Patent and Trademark Office*